US006736653B2

(12) United States Patent
Hall et al.

(10) Patent No.: US 6,736,653 B2
(45) Date of Patent: May 18, 2004

(54) ELECTRICAL CONNECTOR ASSEMBLY FOR COAXIAL CABLES

(75) Inventors: John Wesley Hall, Harrisburg, PA (US); John Mark Myer, Millersville, PA (US); Michael Fredrick Laub, Harrisburg, PA (US); Hurley Chester Moll, Harrisburg, PA (US); Charles Randall Malstrom, Lebanon, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/191,136

(22) Filed: Jul. 9, 2002

(65) Prior Publication Data

US 2003/0162425 A1 Aug. 28, 2003

Related U.S. Application Data

(60) Provisional application No. 60/360,280, filed on Feb. 27, 2002.

(51) Int. Cl.[7] ..... H01R 13/44
(52) U.S. Cl. ..... 439/144
(58) Field of Search ..... 439/144, 370, 439/372

(56) References Cited

U.S. PATENT DOCUMENTS 6,010,343 A * 1/2000 Konoya et al. ..... 439/144

* cited by examiner

*Primary Examiner*—Javaid H. Nasri

(57) ABSTRACT

The invention provides for an electrical connector including first and second housings having mating ends configured to be joined with one another and retain contacts that are joined when the first and second housings are mated. The first and second housings each have a reception end receiving a dielectric subassembly carrying an electrical cable connected to contacts. The dielectric subassemblies are aligned along a longitudinal axis and mate with one another when the first and second housings are mated. The first and second housings each have a hatch proximate a corresponding reception end that closes the reception end and engages a rear wall of the dielectric subassembly. At least one of the hatch and rear wall have a loading protrusion that engages another one of the hatch and rear wall to create a load force along the longitudinal axis to maintain the dielectric subassemblies fully mated with one another.

23 Claims, 8 Drawing Sheets

ELECTRICAL CONNECTOR ASSEMBLY FOR COAXIAL CABLES

RELATED APPLICATIONS

This application is related to, and claims priority from, Provisional Application No. 60/360,280, filed Feb. 27, 2002, titled "Electrical Connector Assembly for Coaxial Cables," the complete subject matter of which is incorporated herein by reference in its entirety.

BACKGROUND OF THE INVENTION

Certain embodiments of the present invention relate to connector assemblies that electrically interconnect coaxial cables. More particularly, certain embodiments of the present invention relate to connector assemblies that preload dielectrics within matable housings such that the dielectrics are in full mating contact with each other when connected.

In the past, connectors have been proposed for interconnecting coaxial cables. Generally, coaxial cables have a circular geometry formed with a central conductor (of one or more conductive wires) surrounded by a cable dielectric material. The dielectric material is surrounded by a cable braid (of one or more conductive wires) that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, it is preferable that the impedance remain matched through the interconnection.

Today, coaxial cables are widely used. Recently, demand has arisen for radio frequency (RF) coaxial cables in applications such as the automotive industry. The demand for RF coaxial cables in the automotive industry is due in part to the increased electrical content within automobiles, such as AM/FM radios, cellular phones, GPS, satellite radios, Blue Tooth™ compatibility systems and the like. The wide applicability of coaxial cables demands that connected coaxial cables maintain the impedance at the interconnection.

Conventional coaxial connector assemblies include matable plug and receptacle housings carrying dielectric subassemblies. The dielectric subassemblies include dielectrics, metal outer shields, and center contacts. The dielectric subassemblies receive and retain coaxial cable ends, and the outer shields have pins that pierce the jackets to electrically contact the cable braids while the center contacts engage the central conductors. The plug and receptacle housings include interior latches that catch and hold the dielectric subassemblies, and thus the coaxial cable ends, therein. When the plug and receptacle housings are mated, the dielectric subassemblies are engaged such that the outer shields are interconnected and the center contacts are interconnected with the dielectrics interconnected therebetween to form a dielectric between signals sent through the outer shields and signals sent through the center contacts.

The conventional coaxial connector assembly suffers from certain drawbacks. The interior latches allow the dielectric subassemblies to axially float within the plug and receptacle housings. When the plug and receptacle housings are mated, the dielectric subassemblies have a certain longitudinal clearance in order that the mated dielectric subassemblies separate slightly from each other without being disconnected or interrupting the electrical connection. When such a separation occurs, the dielectrics are disengaged to a point that air gaps develop between the connected center contacts and the connected outer shields. Because the air gaps have a different dielectric constant than the dielectrics and cable dielectric material, the impedance experienced by the electric signals changes at the point where the dielectric subassemblies interconnect. The change in impedance causes the electric signals to reflect at the point of interconnection, so more power is required to electrically connect the coaxial cables.

Thus, an improved coaxial connector assembly is needed that avoids the above noted problems and other disadvantages experienced heretofore.

BRIEF SUMMARY OF THE INVENTION

Certain embodiments of the present invention include an electrical connector assembly including first and second housings having mating ends configured to be joined with one another and configured to retain contacts that are joined when the first and second housings are mated. The first and second housings each have a reception end receiving a dielectric subassembly configured to carry an electrical cable connected to a contact. The dielectric subassemblies are aligned along a common longitudinal axis and mate with one another when the first and second housings are mated. Each of the first and second housings have a hatch proximate a corresponding reception end. The hatch closes the corresponding reception end and engages a rear wall of the dielectric subassembly. A load protrusion is provided on at least one of the hatch and rear wall. The load protrusion resistibly engages another one of the hatch and rear wall to create a load force along the longitudinal axis that maintains the dielectric subassemblies fully mated with one another.

Certain embodiments of the present invention include an electrical connector including a housing having a reception and a mating end opposite one another along a longitudinal axis of the housing. The electrical connector includes a dielectric subassembly configured to carry, and electrically connect to, an electrical cable. The dielectric subassembly is slidably received in an opening in the reception end of the housing. The electrical connector includes a hatch mounted to the housing proximate the reception end. The hatch closes the reception end and engages a rear wall of the dielectric subassembly. At least one of the hatch and the rear wall have a loading protrusion mounted thereon. The loading protrusion applies a binding load force biasing the dielectric subassembly along the longitudinal axis toward the mating end.

Figure 1:
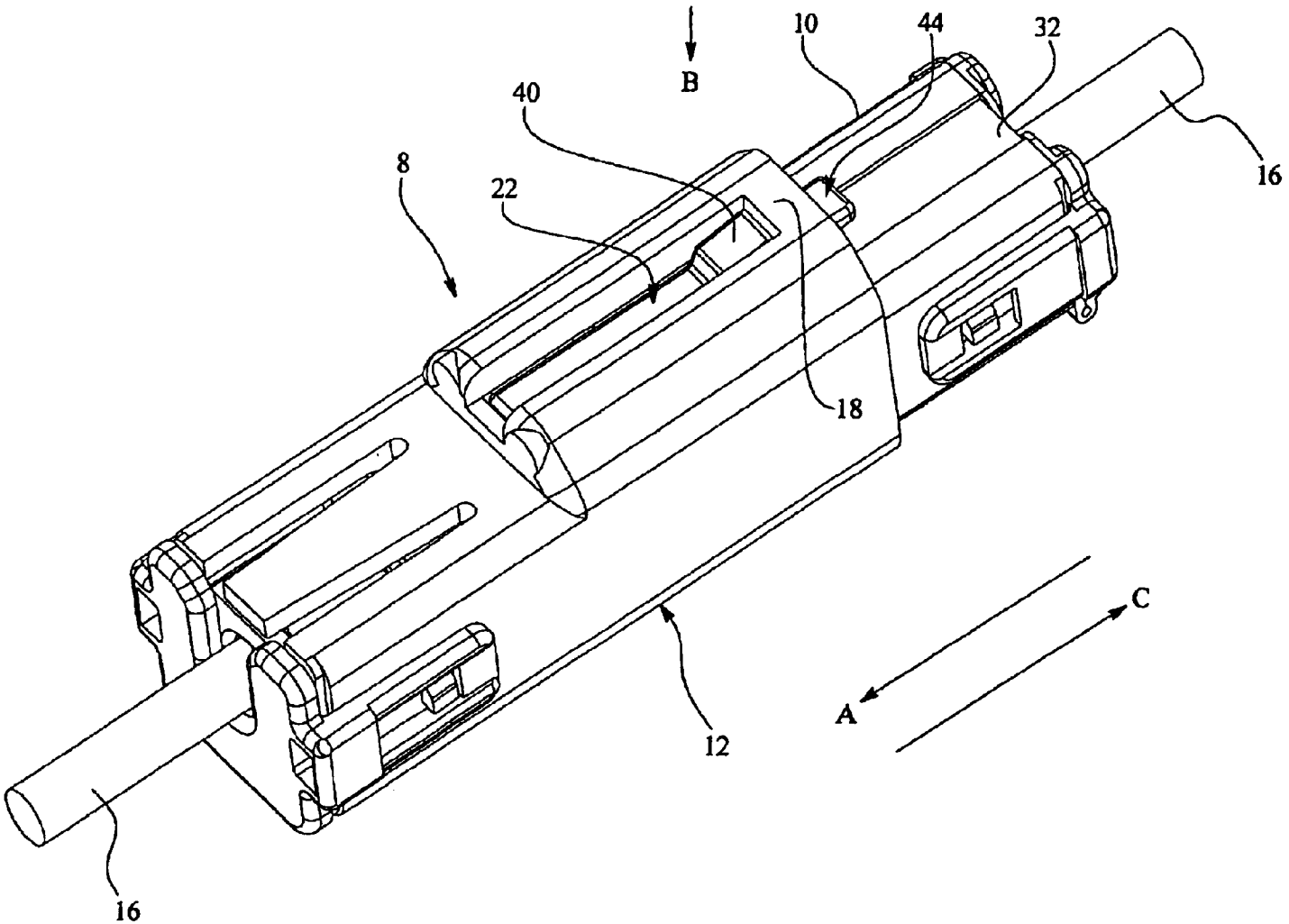
FIG. 1 illustrates a top isometric view of an electrical connector assembly according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a top isometric view of an electrical connector assembly 8 according to an embodiment of the present invention. The electrical connector assembly 8 includes a plug housing 10 and a receptacle housing 12 that each carry a coaxial cable 16. The receptacle housing 12 slidably receives the plug housing 10 to electrically connect the coaxial cables 16. The plug and receptacle housings 10 and 12 are maintained in mating contact by a deflectable latch 40 extending from a top wall 32 of the plug housing 10. When the plug housing 10 is slidably inserted into the receptacle housing 12 in the direction of arrow A, the deflectable latch 40 is biased in the direction of arrow B such that the deflectable latch 40 slides under a retention strip 18 of the receptacle housing 12 into a gap 22. The plug housing 10 is fully inserted into the receptacle housing 12 when the deflectable latch 40 is positioned in the gap 22 and laterally engages the retention strip 18. To disengage the plug and receptacle housings 10 and 12, the deflectable latch 40 is again biased inward by pushing a latch beam 44 in the direction of arrow B, and the plug housing 10 is slidably removed from the receptacle housing 12 in the direction of arrow C until the deflectable latch 40 no longer engages the retention strip 18.

Figure 2:
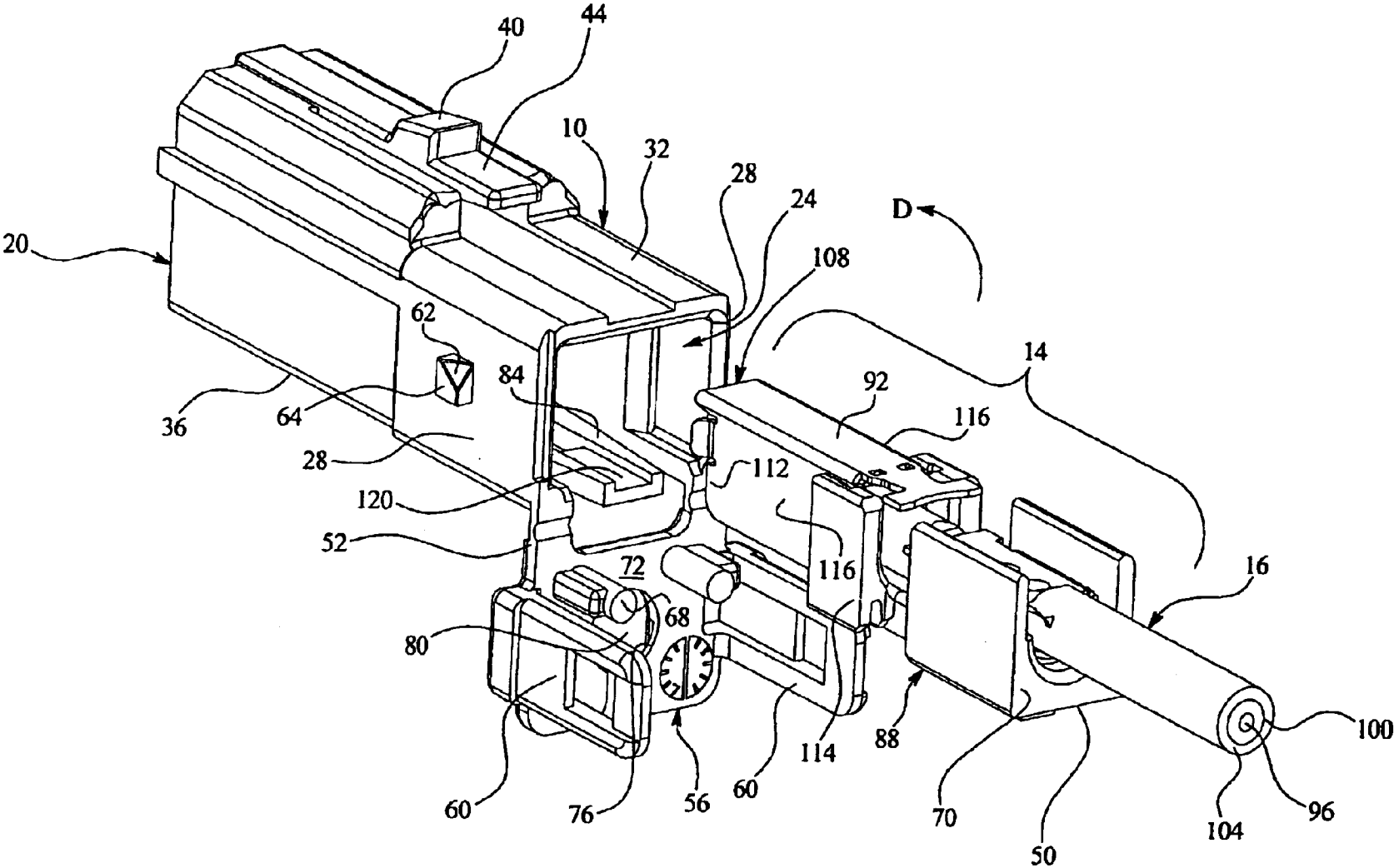
FIG. 2 illustrates an exploded isometric view of a plug housing, coaxial cable, and dielectric subassembly according to an embodiment of the present invention.

FIG. 2 illustrates an exploded isometric view of the plug housing 10, the coaxial cable 16, and a dielectric subassembly 14 according to an embodiment of the present invention. The plug housing 10 is defined by opposite side walls 28 formed with top and bottom walls 32 and 36 that include a mating end 20 and a reception end 24. The top wall 32 includes the deflectable latch 40 and latch beam 44. The bottom wall 36 includes an A-shaped prong 120 with guide beams 84 extending inward within the plug housing 10. The guide beams 84 are aligned with, and slidably receive, the dielectric subassembly 14 along a rear wall 50 as the dielectric subassembly 14 is inserted into the plug housing 10. The guide beams 84 properly orient and retain the dielectric subassembly 14 within the plug housing 10.

The bottom wall 36 also includes hinges 52 that extend to an opened hatch 56 that is perpendicular to the bottom wall 36. Retention latches 60 extend perpendicularly from the hatch 56 opposite each other. The retention latches 60 slide over sloped faces 62 of latch catches 64 extending from the side walls 28 and receive the latch catches 64 when the hatch 56 is rotated 180 degrees in the direction of arrow D to close the reception end 24. The hatch 56 also includes cylindrical loading protrusions 68 that extend outward from an interior surface 72 of the hatch 56. The loading protrusions 68 are formed of plastic or any other resilient material and engage and resist a rear wall 70 of the dielectric subassembly 14 when the dielectric subassembly 14 is loaded within the plug housing 10. Additionally, the hatch 56 includes a gap 76 leading to a cable hole 80 through which the coaxial cable 16 extends when positioned within the plug housing 10 and the dielectric subassembly 14.

The dielectric subassembly 14 includes a plastic dielectric 88 connected to a rectangular metal outer shield 92. The dielectric subassembly 14 receives and retains the coaxial cable 16. The coaxial cable 16 includes a central conductor 96 concentrically surrounded by a dielectric material 100 which in turn is concentrically surrounded by a cable braid 104 that serves as a ground pathway. The dielectric 88 includes a leading portion 114 that engages catches (not shown) on the side walls 28 inside the plug housing 10 that retain the dielectric subassembly 14 therein. The outer shield 92 includes conductive pins (not shown) that extend into the cable braid 104 to join the ground pathway. The outer shield 92 also includes anti-stubbing members 112 extending from a side wall 116 proximate an interface end 108 of the dielectric assembly 14. The anti-stubbing members 112 engage corresponding anti-stubbing members 238 (FIG. 6) on a dielectric subassembly 150 of the receptacle housing 12 such that the outer shield 92 overlaps an outer shield 234 (FIG. 6) on the dielectric subassembly 150. The outer shield 92 also includes an S-shaped locking member (not shown) on a side wall 116. The locking member engages a mating outer shield 234 (FIG. 6) near an end of the outer shield 234 of the dielectric subassembly 150. Likewise, the outer shield 234 includes an S-shaped latching member (not shown) on a side wall 242 (FIG. 6) of the dielectric assembly 150. The locking member on the side wall 242 engages the outer shield 92 near an end of the outer shield 92. The locking members engage each other and hold the outer shields 92 and 234 in contact by maintaining a constant normal force between the outer shields 92 and 234.

A contact tab (not shown) within the dielectric subassembly 14 engages the conductor 96 of the coaxial cable 16 to join the electric signal pathway. A rectangular front portion (not shown) extends from the dielectric 88 and separates the contact tab and the outer shield 92 at the interface end 108. The dielectric constant of the front portion is similar to the dielectric constant of the dielectric material 100 in order to maintain a constant impedance between the interconnected coaxial cables 16 and thus prevent the reflection of electric signals traveling along the coaxial cables 16.

Figure 3:
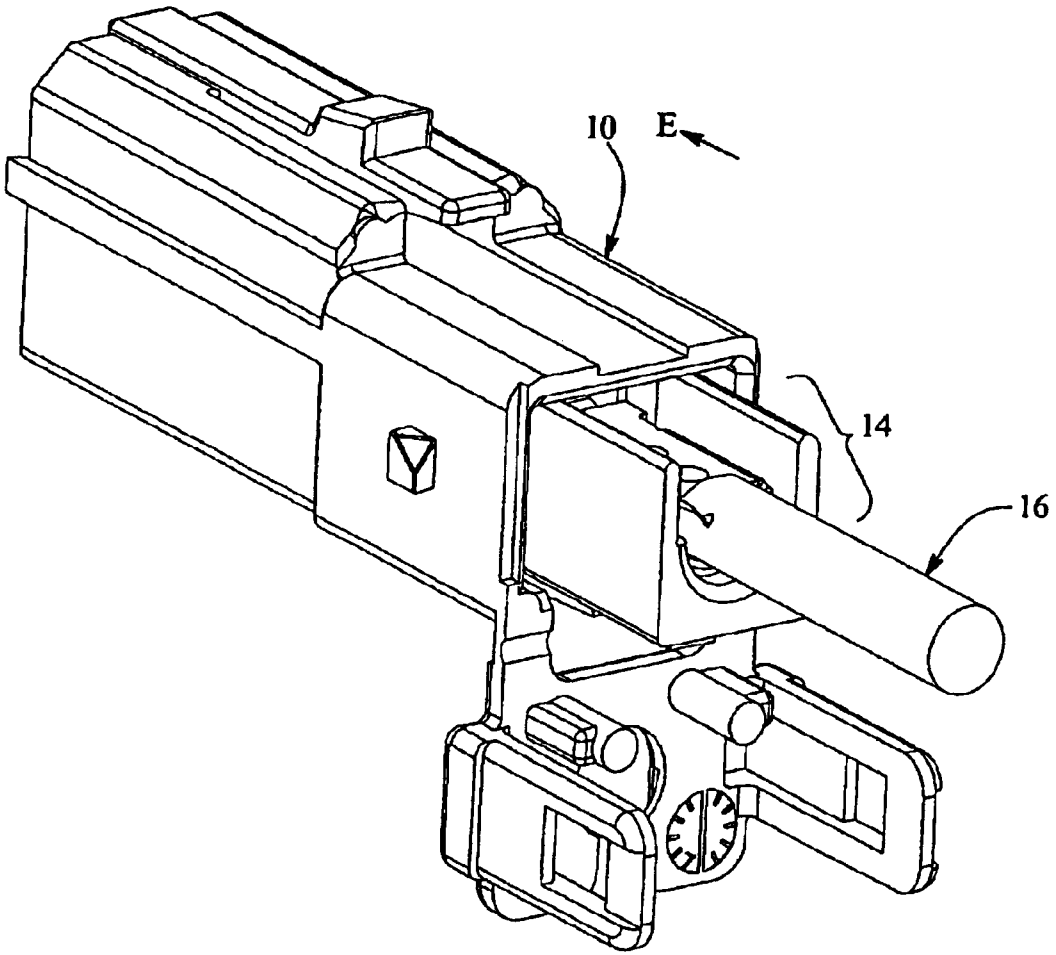
FIG. 3 illustrates an isometric view of the coaxial cable and dielectric subassembly partially inserted into the plug housing.
Figure 4:
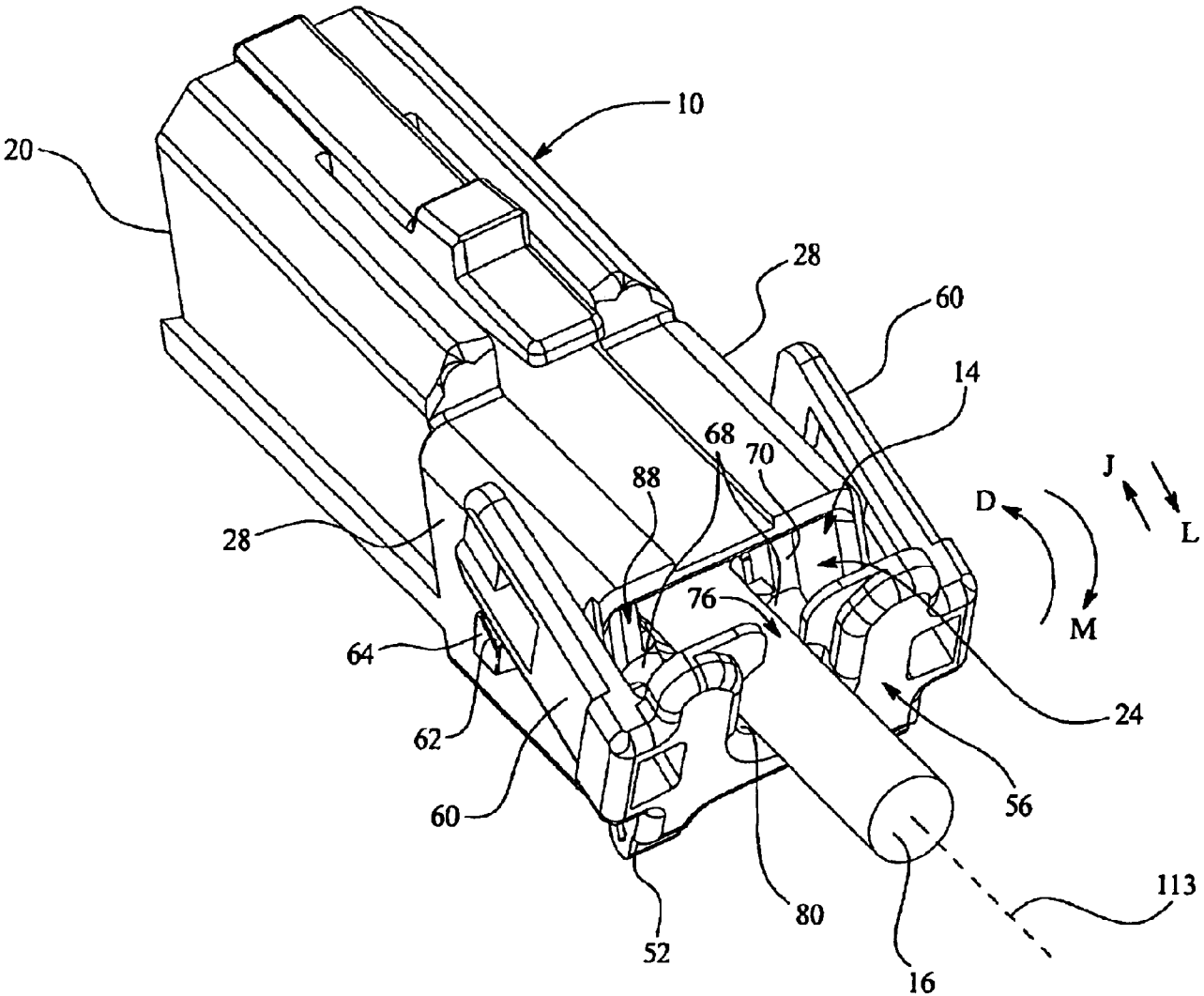
FIG. 4 illustrates an isometric view of the coaxial cable and dielectric subassembly fully inserted into the plug housing.

In operation, as shown in FIG. 3, the dielectric subassembly 14 retaining the coaxial cable 16 is inserted in the direction of arrow E into the plug housing 10. When the dielectric subassembly 14 is fully inserted into the plug housing 10 as shown in FIG. 4 such that the leading portions 114 (FIG. 2) are resisted by the catches of the side walls 28, the hatch 56 is closed by rotating about the hinges 52 in the direction of arrow D. As the hatch 56 is closed, the coaxial cable 16 is pinched within the gap 76 and slides therethrough into the cable hole 80. Additionally, as the hatch 56 is closed, the retention latches 60 slide along the side walls 28 and deflect outward away from each other about the sloped faces 62 until receiving the latch catches 64, thus holding the hatch 56 closed about the dielectric subassembly 14.

Figure 5:
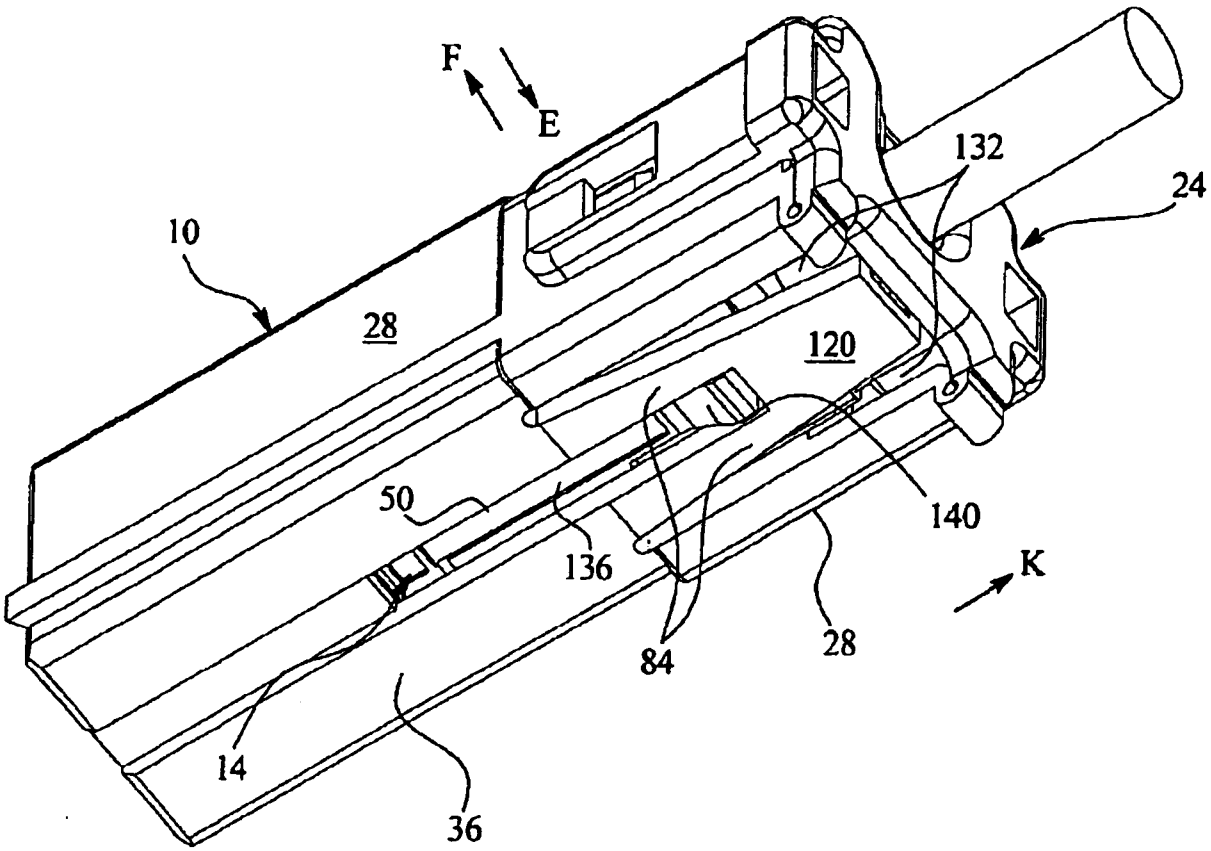
FIG. 5 illustrates a bottom isometric view of the coaxial cable and dielectric subassembly fully inserted into the plug housing.

FIG. 5 illustrates a bottom isometric view of the coaxial cable 16 and dielectric subassembly 14 fully inserted into the plug housing 10. The prong 120 extends from the bottom wall 36 of the plug housing 10 along the guide beams 84 toward the reception end 24. The prong 120 is separated from the side walls 28 by slots 132, and a gap 136 extends between the guide beams 84 along the center of the bottom wall 36. A latch 140 extends from the rear wall 50 of the dielectric subassembly 14 into the gap 136 and engages the prong 120. Thus, as the dielectric subassembly 14 is inserted into the plug housing 10, the latch 140 slides along the prong 120 and deflects the prong 120 in the direction of arrow J until the latch 140 enters the gap 136. Once the latch 140 is in the gap 136 and pushing against the prong 120 in the direction of arrow L, the dielectric subassembly 14 is initially retained within the plug housing 10 and the hatch 56 is closed. Alternatively, to release the dielectric subassembly 14, the latch 140 is biased in the direction of arrow F until no longer engaging the prong 120, and the dielectric subassembly 14 is slid in the direction of arrow L.

Returning to FIG. 4, when the hatch 56 is rotated to close the reception end 24, the loading protrusions 68 engage and push against the rear wall 70 of the dielectric 88 in the direction of arrow E. Because the dielectric 88 is formed of a harder plastic than the loading protrusions 68 or the hatch 56, the dielectric 88, which is braced against the catches on the side walls 28, resists the pressure of the loading protrusions 68 and the hatch 56 in the direction of arrow L, causing the loading protrusions 68 to compress and the hatch 56 to slightly buckle outward along the longitudinal axis 113. The loading protrusions 68 thus deliver a load force along a longitudinal axis 113 against the hatch 56 and the rear wall 70 such that the dielectric subassembly 14 is preloaded within the plug housing 10 between the catches on the side walls 28 and the loading protrusions 68. Because of the pressure of the load force delivered by the loading protrusions 68, the dielectric subassembly 14 does not float along the longitudinal axis 113. The plug housing 10 is then mateably received by the receptacle housing 12 (FIG. 1) to electrically connect the coaxial cables 16.

The hatch 56 is opened by pulling the retention latches 60 outward in opposite directions away from each other such that the retention latches 60 clear the latch catches 64, and then rotating the hatch 56 in the direction of arrow M about the hinges 52. In an alternative embodiment, the loading protrusions 68 are connected to the rear wall 70 of the dielectric 88 to resistibly engage the hatch 56 as the hatch 56 is closed about the reception end 24.

Figure 6:
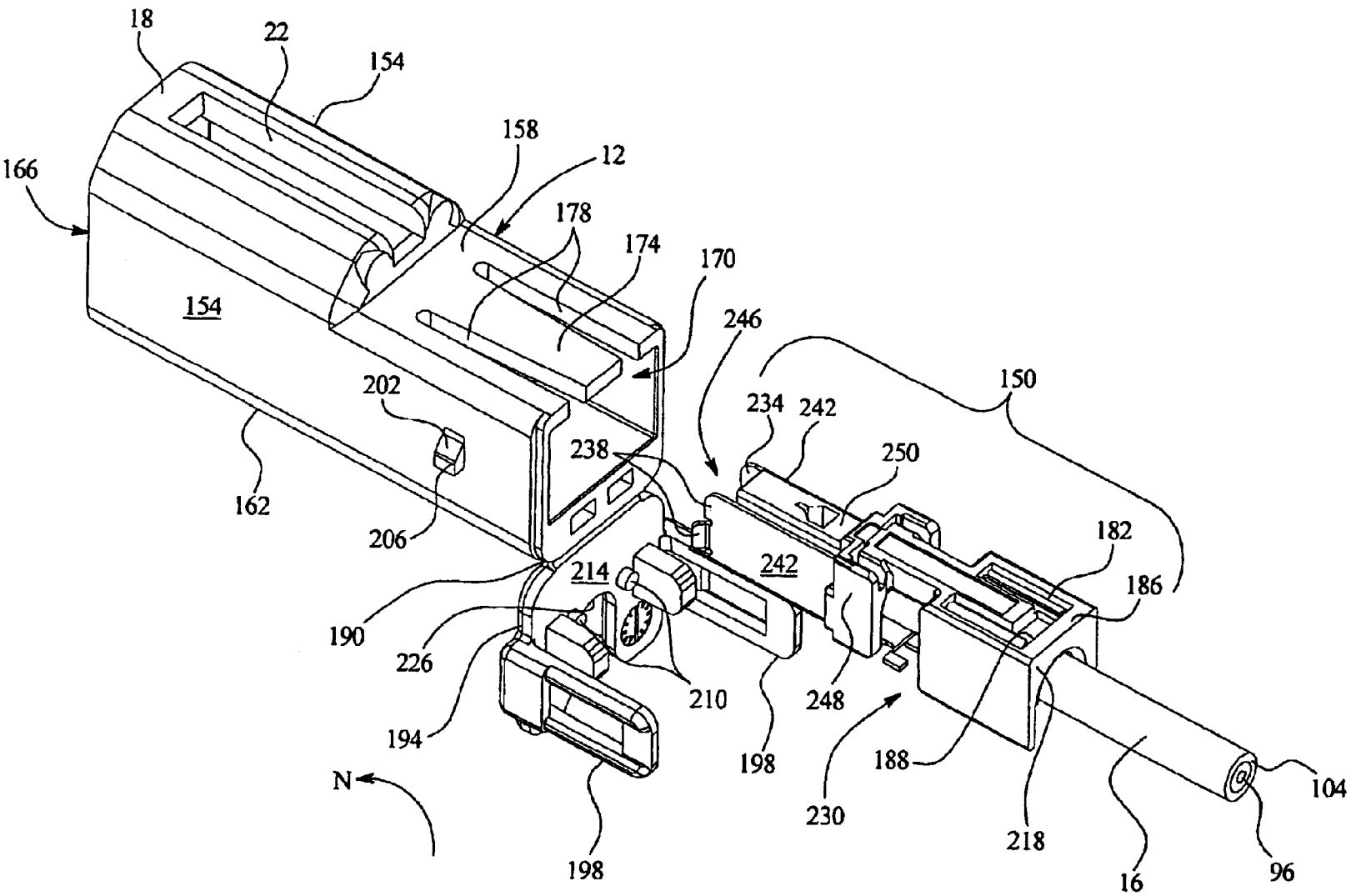
FIG. 6 illustrates an exploded isometric view of a receptacle housing, coaxial cable, and dielectric subassembly according to an embodiment of the present invention.

FIG. 6 illustrates an exploded isometric view of the receptacle housing 12, the coaxial cable 16, and a dielectric subassembly 150. The receptacle housing 12 is defined by opposite side walls 154 formed with top and bottom walls 158 and 162 that include a mating end 166 and a reception end 170. The top wall 158 includes a prong 174 extending toward the reception end 170 and separated from the side walls 154 by slots 178. The prong 174 slides along a top wall 182 of the dielectric subassembly 150 as the dielectric subassembly 150 is inserted into the receptacle housing 12 and slidably enters a pocket 188 proximate the rear wall 186 of the dielectric subassembly 150 when the dielectric subassembly 150 is fully inserted into the receptacle housing 12. The top wall 158 also includes the gap 22 and retention strip 18 that retain the deflectable latch 40 of the plug housing 10 (FIG. 1).

The bottom wall 162 includes hinges 190 that extend to an opened hatch 194, similar to the plug housing 10 of FIG. 2. Retention latches 198 extend perpendicularly from the hatch 194 opposite each other. The retention latches 198 slide over sloped faces 202 of latch catches 206 extending from the side walls 154 and receive the latch catches 206 when the hatch 194 is rotated 180 degrees in the direction of arrow N to close the reception end 170. The hatch 194 also includes cylindrical loading protrusions 210 that extend outward from an interior surface 214 of the hatch 194. The loading protrusions 210 are formed of plastic or any other resilient material and engage and resist the rear wall 186 of the dielectric subassembly 150 when the dielectric subassembly 150 is loaded within the receptacle housing 12. Additionally, the hatch 194 includes a gap (not shown) leading to a cable hole 226 through which the coaxial cable 16 extends when positioned within the receptacle housing 12 and the dielectric subassembly 150.

The dielectric subassembly 150 includes a plastic dielectric 230 connected to the rectangular metal outer shield 234. The dielectric 230 includes a leading portion 248 that engages catches (not shown) on the side walls 154 inside the receptacle housing 12 that retain the dielectric subassembly 150 therein. The outer shield 234 includes conductive pins (not shown) that extend into the cable braid 104 of the coaxial cable 16 to join the ground pathway. The outer shield 234 also includes the anti-stubbing members 238 extending from a side wall 242 proximate an interface end 246 of the dielectric assembly 150 and the S-shaped locking member (not shown) extending from the opposite side wall 243. A contact tab (not shown) within the dielectric subassembly 150 engages the central conductor 96 of the coaxial cable 16 to join the electric signal pathway. A rectangular front portion 250 extends from the dielectric 230 and separates the contact tab and the outer shield 234 at the interface end 246. The front portion 250 maintains the dielectric constant between the interconnected coaxial cables 16 shown in FIG. 1.

Figure 7:
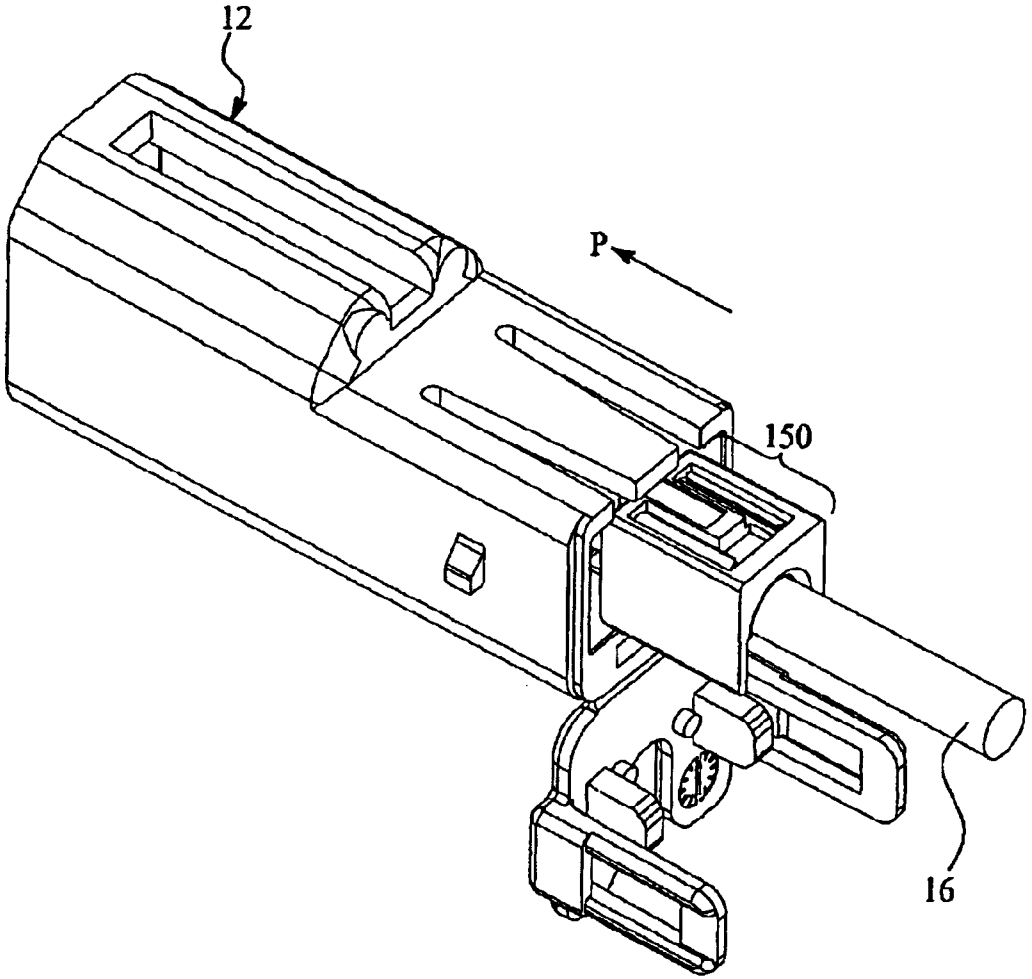
FIG. 7 illustrates an isometric view of the coaxial cable and dielectric subassembly partially inserted into the plug housing.
Figure 8:
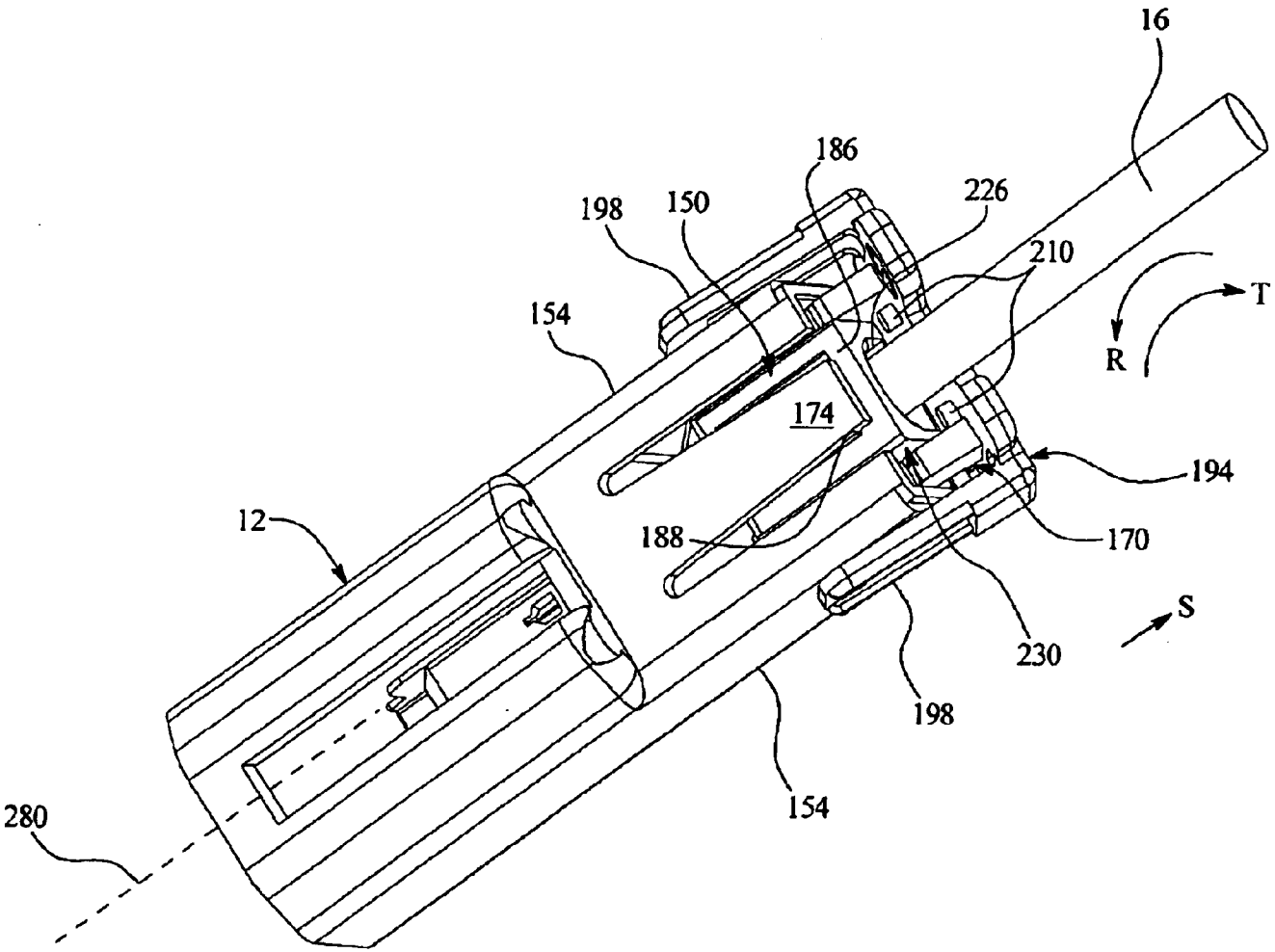
FIG. 8 illustrates an isometric view of the coaxial cable and dielectric subassembly partially inserted into the receptacle housing.

In operation, as shown in FIG. 7, the dielectric subassembly 150 retaining the coaxial cable 16 is positioned in the direction of arrow P into the receptacle housing 12. FIG. 8 illustrates a top isometric view of the coaxial cable 16 and the dielectric subassembly 150 partially inserted into the receptacle housing 12. The dielectric subassembly 150 is fully inserted into the receptacle housing 12 when the leading portions 248 (FIG. 6) are resisted by the catches of the side walls 154, preventing the dielectric subassembly 150 from being further inserted into the receptacle housing 12. The hatch 194 is then closed by rotating about the hinges 190 (FIG. 6) in the direction of arrow N. As the hatch 194 is closed, the coaxial cable 16 is pinched within the gap and slides therethrough into the cable hole 226. Additionally, as the hatch 194 is closed, the retention latches 198 slide along the side walls 154 and deflect outward away from each other about the sloped faces 202 (FIG. 6) until receiving the latch catches 206 (FIG. 6), thus holding the hatch 194 closed about the dielectric subassembly 150.

When the hatch 194 is rotated to close the reception end 170, the loading protrusions 210 engage and push against the rear wall 186 in the direction of arrow P such that the dielectric subassembly 150 is firmly retained within the receptacle housing 12. Because the dielectric 230 is formed of a harder plastic than the loading protrusions 210 or the hatch 194, the dielectric 230, which is braced against the catches on the side walls 154, resists the pressure of the loading protrusions 210 and hatch 194 in the direction of arrow S, causing the loading protrusions 210 to compress and the hatch 194 to slightly buckle. The loading protrusions 210 thus deliver a load force along a longitudinal axis 280 against the hatch 194 and the rear wall 186 such that the dielectric subassembly 150 is preloaded within the receptacle housing 12 between the catches on the side walls 154 and the loading protrusions 210. Because of the pressure of the load force delivered by the loading protrusions 210, the dielectric subassembly 150 does not float along the longitudinal axis 280.

The hatch 194 is opened by pulling the retention latches 198 outward in opposite directions away from each other such that the retention latches 198 clear the latch catches 206 (FIG. 6), and then rotating the hatch 194 in the direction of arrow T about the hinges 190 (FIG. 6). In an alternative embodiment, the loading protrusions 210 may be connected to the rear wall 186 of the dielectric 230 to resistibly engage the hatch 194 as the hatch 194 is closed about the reception end 170.

The receptacle housing 12 mateably receives the plug housing 10 to electrically connect the dielectric subassemblies 14 (FIG. 2) and 150. As the preloaded dielectric subassemblies 14 and 150 are connected within the receptacle housing 12, the outer shields 234 and 92 (FIG. 2) are electrically engaged and held together by the locking members and the central conductors 96 of the coaxial cables 16 are electrically connected via the center contacts. Similarly, the dielectrics 88 and 230 engage each other between the connected outer shields 234 and 92 and the connected center contacts, thus forming a dielectric barrier therebetween. Because the dielectric subassemblies 14 and 150 are prevented from axially floating by the loading protrusions 68 (FIG. 2) and 210, respectively, the dielectric subassemblies 14 and 150 are fully engaged so air gaps do not develop between the connected outer shields 234 and 92 and the connected center contacts. Thus, the impedance experienced by the electric signals passing from one coaxial cable 16 to another is not altered where the coaxial cables 16 interconnect and less electrical power is necessary to effectively send the electric signals between the coaxial cables 16.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

first and second housings having mating ends configured to be joined with one another and configured to retain contacts that are joined when said first and second housings are mated, said first and second housings each having a reception end receiving a dielectric subassembly configured to carry an electrical cable, said dielectric subassemblies of said first and second housings each extending along a longitudinal axis, said longitudinal axis of each of said first and second dielectric subassemblies being aligned when said first and second housings are joined together to mate said first and second dielectric subassemblies; and each of said first and second housings having a reception end and a hatch proximate said reception end, said hatch closing said reception end and engaging a rear wall of a respective one of said dielectric subassemblies, wherein a loading protrusion is provided on at least one of said hatch and rear wall, said loading protrusion resistibly engaging the other of said hatch and rear wall to create a longitudinal load force that maintains said dielectric subassemblies fully mated with one another.

2. The electrical connector assembly of claim 1, wherein said loading protrusion includes a body having opposing ends, said loading protrusion extending longitudinally between said rear wall and said hatch such that one of said opposing ends engages said hatch and the other of said opposing ends engages said rear wall.

3. The electrical connector assembly of claim 1, wherein one of said hatch and rear wall include a plurality of said loading protrusions thereon that resistibly engage the other of said hatch and rear wall.

4. The electrical connector assembly of claim 1, wherein said loading protrusion includes opposing ends, said loading protrusion being positioned and compressed between said rear wall and said hatch such that said opposing ends are pushed toward each other.

5. The electrical connector assembly of claim 1, wherein said first and second housings have side walls, said side walls having interior catches that retain said dielectric subassemblies such that said dielectric subassemblies are axially compressed between said loading protrusion and said catches when said hatch is closed.

6. The electrical connector assembly of claim 1, wherein said loading protrusion is compressed between a rear wall of one of said dielectric subassemblies and said hatch, said loading protrusion exerting said load force to prevent said dielectric assemblies from floating away from one another.

7. The electrical connector assembly of claim 1, wherein said hatch of each of first and second housings includes a retention latch and each of said first and second housings includes a side wall with a latch catch, said retention latches engaging said latch catches such that said hatches of each of said first and second housing are releasably secured about said reception ends of said first and second housings when said hatches are closed.

8. The electrical connector assembly of claim 1, wherein said first housing has a deflectable latch and said second housing has a latch gap configured to releasably retain said deflectable latch in order to connect said mating ends of said first and second housings such that corresponding dielectric subassemblies of said first and second housings resistibly engage each other along said longitudinal axis due to said load forces.

9. The electrical connector assembly of claim 1, wherein each hatch has a gap and a cable hole configured to receive and retain said electrical cable when said hatch is closed.

10. The electrical connector assembly of claim 1, wherein said first housing has a prong on a bottom wall, said prong having a gap that receives and retains a latch extending from a rear wall of said dielectric subassembly to hold said dielectric subassembly in an initial position when said hatch of said first housing is closed about said reception end.

11. The electrical connector assembly of claim 1, wherein said dielectric subassemblies have metal shields and contact tabs separated by dielectrics, said metal shields of corresponding dielectric subassemblies having anti-stubbing members that engage each other such that said metal shields overlap each other and are in electrical contact when said first and second housings are mated.

12. An electrical connector, comprising:

a housing having a reception end and an opposed mating end aligned along a longitudinal axis of said housing;

a dielectric subassembly configured to carry, and electrically connect to, an electrical cable, said dielectric subassembly being slidably received in an opening in said reception end of said housing; and a hatch mounted to said housing proximate said reception end, said hatch closing said reception end and engaging a rear wall of said dielectric subassembly, at least one of said hatch and said rear wall having a loading mounted thereon, said loading protrusion being cylindrical in shape with opposite top and bottom ends, said loading protrusion being positioned between said rear wall and said hatch along said longitudinal axis such that said top end engages at least one of said hatch and rear wall and said bottom end engages another one of said hatch and said rear wall, said loading protrusion applying a binding load force biasing said dielectric subassembly along said longitudinal axis toward said mating end.

13. The electrical connector assembly of claim 12, further comprising a second housing carrying a second dielectric subassembly and configured to receive said housing such that said dielectric subassembly and said second dielectric subassembly electrically connect, wherein said housing has a deflectable latch and said second housing has a latch gap configured to releasably retain said deflectable latch in order to secure said housing and said second housings to each other to maintain contact between said dielectric subassembly and said second dielectric subassembly.

14. The electrical connector assembly of claim 12, wherein one of said hatch and rear wall have a plurality of said loading protrusions thereon that resistibly engage another one of said hatch and rear wall.

15. The electrical connector assembly of claim 12, wherein said loading protrusion includes opposite top and bottom ends that are positioned and compressed between said rear wall and said hatch along said longitudinal axis such that said top and bottom ends are pushed toward each other along said longitudinal axis.

16. The electrical connector assembly of claim 12, wherein said housing has side walls, said side walls having interior catches that retain said dielectric subassembly such that said dielectric subassembly is compressed between said loading protrusion and said catches, thus limiting movement along said longitudinal axis by said dielectric subassembly.

17. The electrical connector assembly of claim 12, wherein said loading protrusion is compressed between said rear wall and said hatch such that said loading protrusion exerts a load force along said longitudinal axis against said hatch and said rear wall preventing said dielectric assembly from floating in either direction along said longitudinal axis.

18. The electrical connector assembly of claim 12, wherein said hatch has retention latches and said housing has side walls with latch catches, said retention latches engaging said latch catches such that said hatch is releasably secured about said reception end of said housing in a closed position with said loading protrusion engaging said hatch and said rear wall of said dielectric subassembly.

19. The electrical connector assembly of claim 12, wherein said housing has a prong on a bottom wall, said prong having a gap that receives and retains a latch extending from a rear wall of said dielectric subassembly to hold said dielectric subassembly in an initial position such that said hatch is closed about said reception end.

20. The electrical connector assembly of claim 12, further comprising a second housing having a second mating end and a second reception end, said second housing receiving a second dielectric subassembly at said second reception end and said second mating end being configured to receive said mating end of said housing such that said dielectric subassembly and said second dielectric subassembly electrically connect.

21. The electrical connector assembly of claim 12, wherein said hatch has a gap and a cable hole that receive and retain said electrical cable when said hatch is closed about said dielectric subassembly.

22. An electrical connector, comprising:

a housing having a reception and a mating end opposite one another along a longitudinal axis of said housing;

a dielectric subassembly configured to carry, and electrically connect to, an electrical cable, said dielectric subassembly being slidably received in an opening in said reception end of said housing; and a hatch mounted to said housing proximate said reception end, said hatch closing said reception end and engaging a rear wall of said dielectric subassembly, at least one of said hatch and said rear wall having a plurality of loading protrusions mounted thereon that resistibly engage another one of said hatch and rear wall, said loading protrusions being formed of a compressive material with opposite top and bottom ends, said top and bottom ends being compressible toward one another along a length of said material to apply a binding load force biasing said dielectric subassembly along said longitudinal axis toward said mating end.

23. The electrical connector assembly of claim 22, wherein said loading protrusions are positioned and compressed between said rear wall and said hatch along said longitudinal axis such that said top and bottom ends are pushed toward each other along said longitudinal axis.

* * * * *